US006128931A

United States Patent [19]

Woods

[11] Patent Number: 6,128,931

[45] Date of Patent: Oct. 10, 2000

[54] SYSTEM AND METHOD FOR LAUNDERING CLEAN ROOM GARMENTS WITHIN A SEMICONDUCTOR FABRICATION CLEAN ROOM FACILITY

[75] Inventor: Robert L. Woods, Johnson City, Tex.

[73] Assignee: Advanced Micro Devices, Inc., Sunnyvale, Calif.

[21] Appl. No.: 09/227,504

[22] Filed: Jan. 6, 1999

[51] Int. Cl.[7] ..... D06F 35/00

[52] U.S. Cl. ..... 68/3 R; 68/13 R; 68/210

[58] Field of Search ..... 68/3 R, 13 R, 68/210

[56] References Cited

U.S. PATENT DOCUMENTS

| | | | |
|---|---|---|---|
| 1,967,940 | 7/1934 | Johnson | 68/3 R X |
| 3,318,122 | 5/1967 | Starr et al. | 68/210 |
| 3,597,943 | 8/1971 | Gayring | 68/210 |
| 4,561,268 | 12/1985 | Southwick et al. | 68/210 |
| 5,003,794 | 4/1991 | Griffis | 68/3 R |
| 5,511,263 | 4/1996 | Reinert, Sr. | 68/3 R X |

OTHER PUBLICATIONS http://www.escoasia.com/store/services/decontamination/index.htm; "Decontamination/Laundry Services, " Jul. 15, 1998.

*Primary Examiner*—Philip R. Coe
*Attorney, Agent, or Firm*—Kevin L. Daffer; Conley, Rose & Tayon

[57] ABSTRACT

A system and method are presented for laundering textiles (e.g., clean room garments) within a clean room facility. The textile laundering system may be used to launder clean room garments. The system includes a washing machine, a dryer, and means for measuring the number and sizes of particulates present within laundered textiles. The washing machine has two opposed sides, a loading side and an unloading side, and at least one portion which allows access to mechanical and/or electrical equipment (i.e., an equipment access portion). The washing machine is positioned within a sealed opening in a vertical partition separating a first laundering area from a second laundering area such that the loading side is located within the first laundering area and the unloading side is located within the second laundering area. The washing machine uses only "ultrapure" water, substantially free of ions, minerals, and organic material, to launder the textiles. The dryer is used to remove residual water from the textiles, and also has at least one equipment access portion. The equipment access portions of the washer and dryer are enclosed within at least one service chase such that the equipment access portions are isolated from the first and second laundering areas. The means for measuring the number and sizes of particulates present within laundered textiles may include a Helmke drum and an aerosol particle counter.

8 Claims, 6 Drawing Sheets

Dryer Air Temp.
140°F
Outside Air
Temp.
time

Textile Temp.
140°F
Outside Air
Temp.
time
$t_1$
$t_2$
$t_3$
$t_4$
0

SYSTEM AND METHOD FOR LAUNDERING CLEAN ROOM GARMENTS WITHIN A SEMICONDUCTOR FABRICATION CLEAN ROOM FACILITY

BACKGROUND OF THE INVENTION

1. Field of the Invention

This invention relates to textile laundering systems and methods, and more specifically to systems and methods used to launder clean room garments.

2. Description of Related Art

It is well known that small particles (i. e., particulates) can cause defects in integrated circuits formed upon semiconductor wafers. Such defects may prevent the integrated circuits from performing their intended functions. For example, a process called photolithography is used to pattern layers of desired materials deposited upon the semiconductor wafers. During photolithography, light passing through a pattern on a mask transfers the pattern to a layer of light-sensitive photoresist deposited over a layer of desired material. Particulates on the surface of the mask or on the surface of the photoresist layer which block or diffuse the light cause imperfect pattern registrations (i.e., imperfect feature formations). The resulting imperfect features formed within an integrated circuit may render the integrated circuit inoperable.

In order to help keep wafer processing areas as particle free (i.e., "clean") as possible, such areas are designated as "clean rooms". Particulates may be present within the air in clean rooms, introduced by processing personnel, suspended in liquids and gasses used during wafer processing, and generated by processing equipment located within the clean rooms. As a result, the air within clean rooms is typically continuously filtered. Liquids and gasses entering clean rooms and used during processing are also filtered, and clean rooms typically exclude portions of processing equipment which generate particulates.

Air "cleanliness" levels of clean rooms are determined by the densities of different sizes of particulates present in the air and are specified using class numbers. The allowable densities of particulates within clean rooms is dependent upon the clean room class numbers and the largest dimensions of the particulates. For example, a class 1 clean room can have only 1 particle with a largest dimension of 0.5 micron in each cubic foot of air, but may have up to 34 particles with largest dimensions of 0.1 micron per cubic foot of air. The required class number for a particular clean room is largely determined by the feature sizes of the integrated circuit devices being produced within the clean room. Portions of many integrated circuits produced today are formed within class 1 clean rooms.

Human beings continuously generate large numbers of particulates including dead skin cells and hairs. When working in clean rooms, personnel typically wear low-particle-generating coverings which almost completely envelope their bodies. The clean room garments essentially form filters around the wearers, reducing the number of particulates generated by the wearers which escape into the air. Exemplary garments include overalls and hoods, face masks, safety glasses or goggles, leggings, shoe covers, and gloves. Undergarments such as caps or nets may also be used to keep hair in place under hoods.

Clean room garments must be laundered on a regular basis if they are to remain functional and sanitary. The laundering process must, however, be carried out such that the clean room garments do not become sources of large number of particulates. For example, particles present in the water used to wash the clean room garments, or particles of a laundering agent (e.g., a detergent) added to the water, may become trapped in fibers of the clean room garments during laundering. Such particles may be released into the air during wear of the garments. Improper laundering may also damage the fibers of the clean room garments, causing them to break apart. In this case, small pieces of the fibers may be released into the air during wear.

No matter how carefully the laundering process is carried out, transport of laundered clean room garments through the relatively "dirty" environment between an off-site facility and the clean room presents a particle contamination problem. In fact, the plastic bags routinely used to protect laundered garments are themselves particle generators, rendering them ineffective in protecting clean room garments from the introduction of particles during transit.

It would thus be desirable to have an system and method for laundering clean room garments in a facility adjacent to or within a clean room facility. The desired system would reduce the exposure of clean room garments undergoing a laundering process to sources of particulates. The desired method would further reduce the introduction of particulates into, and damage to the fibers of, the clean room garments.

SUMMARY OF THE INVENTION

The problems outlined above are in large part solved by a system and method for laundering textiles (e.g., clean room garments) within a clean room facility. The system comprises a washing machine, a dryer, and means for measuring the number and sizes of particulates present within laundered textiles. The washing machine has two opposed sides. One of the opposed sides of the washing machine is a loading side for loading textiles into the washing machine, and the other side is an unloading side for unloading textiles from the washing machine. The washing machine also includes at least one portion which allows access to mechanical and/or electrical equipment (i.e., an equipment access portion). The at least one equipment access portion may include, for example, an equipment access panel. The washing machine is positioned within a sealed opening in a vertical partition separating a first laundering area from a second laundering area such that the loading side is located within the first laundering area and the unloading side is located within the second laundering area.

The washing machine uses only "ultrapure" water to launder the textiles. The ultrapure water supplied to the washing machine is substantially free of ions, minerals, and organic material. The dryer is used to remove residual water from the textiles, and also has at least one equipment access portion. The equipment access portions of the washer and dryer are enclosed within at least one service chase such that the equipment access portions are isolated from the first and second laundering areas. The means for measuring the number and sizes of particulates present within laundered textiles may include a Helmke drum and an aerosol particle counter.

In order to prevent particulates in soiled textiles in the first laundering area from contaminating laundered textiles in the second laundering area, a positive air pressure differential is maintained between the second laundering area and the first laundering area such that air will flow from the second laundering area to the first laundering area (e.g., through the washing machine). Further, where the at least one service chase is adjacent to the first laundering area, a positive air pressure differential is maintained between the first laundering area and the adjacent service chase in order to prevent particulates and other contaminants within the service chase from entering the first laundering area. An access door may exist in an opening between the first laundering area and the adjacent service chase. When such a door is opened, the positive pressure differential is maintained between the first laundering area and the at least one service chase such that air flows from the first laundering area and into the service chase.

Similarly, where the at least one service chase is adjacent to the second laundering area, a positive air pressure differential is maintained between the second laundering area and the adjacent service chase in order to prevent particulates and other contaminants within the service chase from entering the second laundering area. An access door may exist in an opening between the second laundering area and the at least one service chase. When such a door is opened, the positive pressure differential is maintained between the second laundering area and the adjacent service chase such that air flows from the second laundering area and into the service chase.

The present method for laundering textiles includes placing the textiles within a first chamber (e.g., a washing machine drum). The textiles are then subjected to a wash operation, wherein the wash operation involves immersing the textiles in ultrapure water. Following the wash operation the textiles are subjected to a series of rinse operations, wherein each of the series of rinse operations involves immersing the textiles in ultrapure water.

The wash operation may include filling the first chamber to a predetermined level with ultrapure water having a temperature within a predetermined range (e.g., between about 120° F. and approximately 130° F.), adding a laundering agent (e.g., a detergent) to the ultrapure water, inducing relative motion between the textiles and the water for a predetermined period of time, and draining the water from the first chamber.

Each of the series of rinse operations may include filling the first chamber to a predetermined level with ultrapure water having a temperature within a predetermined temperature range, inducing relative motion between the textiles and the water for a predetermined period of time, and draining the water from the first chamber. The ultrapure water used in a first rinse operation may have a temperature between about 110° F. and approximately 120° F. The ultrapure water used in a second and any subsequent rinse operations may have a temperature between about 55° F. and approximately 80° F.

Following the series of rinse operations, the textiles may be subjected to at least one spin operation. During each spin operation, the first chamber is rotated about an axis passing through the first chamber such that water is substantially removed from the textiles by centrifugal force.

Following the at least one spin operation, the textiles may be subjected to a drying operation. The drying operation may include placing the textiles within a second chamber (e.g., a dryer drum), rotating the second chamber about an axis passing through the second chamber, and circulating air through the second chamber such that moisture-laden air is removed from the second chamber and relatively dry air is added to the second chamber. In one embodiment, the air added to the second chamber is heated to about 140° F. during a first portion of the drying operation. The duration of the first portion of the drying operation is sufficient to substantially heat the textiles to approximately 140° F. Following the first portion of the drying operation, the air added to the second chamber has a temperature substantially equal to an outside air temperature (e.g., about 40° F. to approximately 95° F.).

Following the drying operation, a portion of the textiles may be subjected to a particulate measurement procedure. The particulate measurement procedure includes measuring the number and sizes of particulates present within the portion of the laundered textiles. The results of the particulate measurement procedure may be used to determine if the textiles (e.g., clean room garments) will emit acceptable levels of particulates into the clean room during use.

BRIEF DESCRIPTION OF THE DRAWINGS

Other objects and advantages of the invention will become apparent upon reading the following detailed description and upon reference to the accompanying drawings in which.

Figure 1:
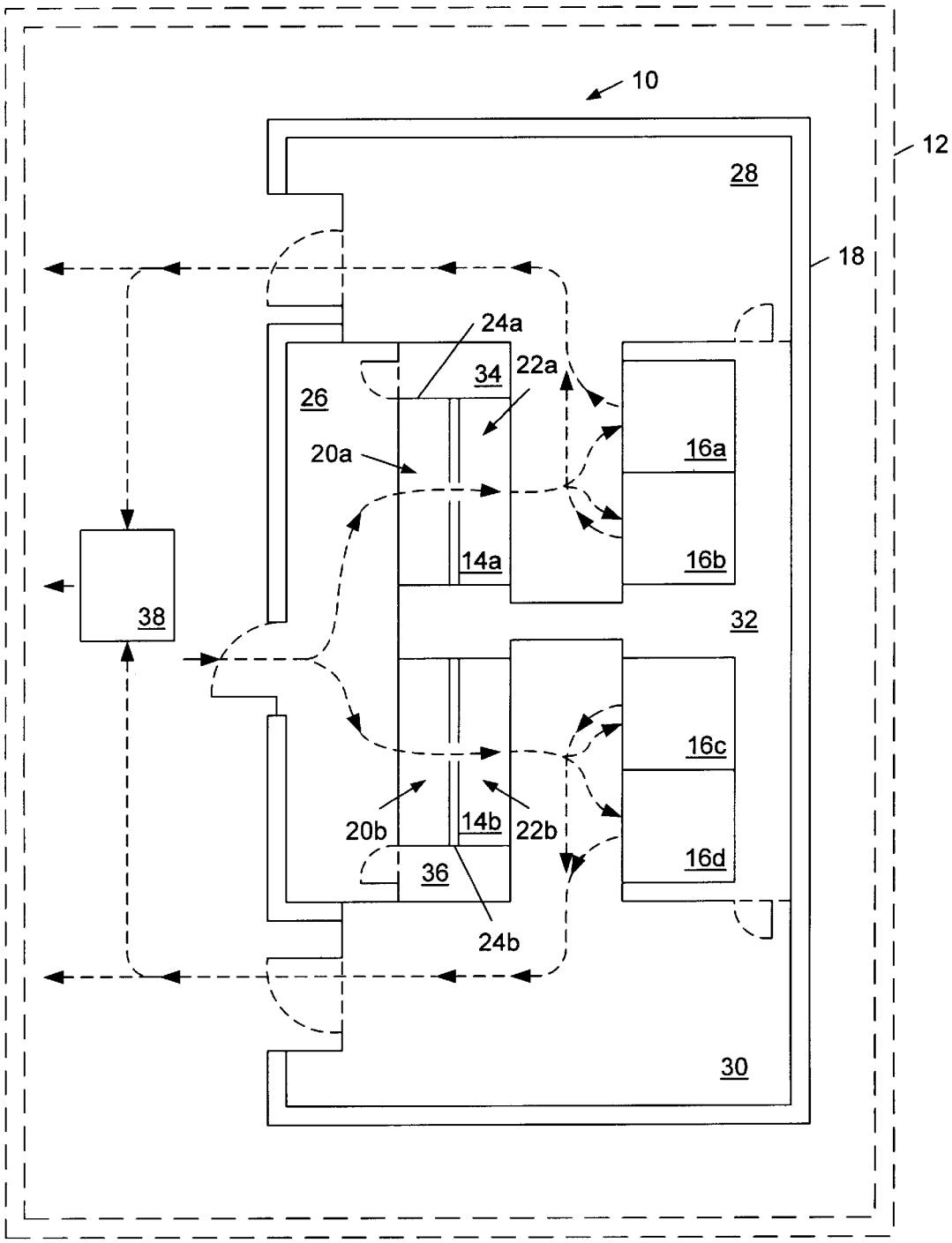
FIG. 1 is a top plan view of one embodiment of a textile laundering system located within a clean room, wherein the textile laundering system includes two washers, four dryers, and a measurement system used to measure the number and sizes of particulates present within laundered textiles.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF PREFERRED EMBODIMENTS

FIG. 1 is a top plan view of one embodiment of a textile laundering system 10 located within a clean room 12. Textile laundering system 10 may be used to launder clean room garments worn by personnel working within clean room 12. Textile laundering system 10 includes two washing machines 14*a–b* and four dryers 16*a–d* located within a laundry room 18. Textiles may be washed within washers 14, then dried within dryers 16. Washing machines 14 and dryers 16 may have cylindrical drums which rotate about an axis which extends longitudinally through the drum, and may have access doors for loading textiles (e.g., clean room garments) into the drums and for removing textiles from the drums.

Washing machine 14*a* has a load side 20*a* for loading textiles into washing machine 14*a* and an opposed unload side 22*a* for unloading textiles from washing machine 14*a*. Washing machine 14*a* is positioned within a sealed opening in a vertical partition 24*a* separating a first laundering area 26 from a second laundering area 28. Loading side 20*a* of washing machine 14*a* is located within first laundering area 26, and unloading side 22*a* of washing machine 14*a* is located within second laundering area 28. Similarly, washing machine 14*b* has a load side 20*b* located within first laundering area 26 and an unloading side 22*b* located within a third laundering area 30, and is positioned within a sealed opening in a vertical partition 24*b* separating first laundering area 26 from third laundering area 30. As a result, a significant amount of physical separation is achieved between soiled textiles (e.g., garments) in laundering area 26 and laundered textiles in laundering areas 28 and 30. Laundering areas 28 and 30 may have different "cleanliness" levels. For example, laundering area 28 may be a class 10 clean room area, and laundering area 30 may be a class 1 clean room area.

Exterior portions of washing machines 14 and dryers 16 allow access to mechanical and/or electrical components for maintenance and repair. Such exterior portions are herein referred to as "equipment access portions". Equipment access portions of washing machines 14 and dryers 16 are enclosed within service chases to prevent particulates and other contaminants generated by the mechanical and/or electrical components, or released during servicing of the components, from escaping into clean room 12. For example, a service chase 32 allows access to equipment access portions of dryers 16 and one side of washing machines 14*a* and 14*b*. Service chase 32 also separates laundry areas 28 and 30. A door in an opening between laundering area 28 and service chase 32 allows access to service chase 32 from laundering area 28, and a door in an opening between laundering area 30 and service chase 32 allows access to service chase 32 from laundering area 30. A service chase 34 allows access to a side of washing machine 14*a* opposite the side enclosed by service chase 32. A door in an opening between laundering area 26 and service chase 34 allows access to service chase 34 from laundering area 26. A service chase 36 allows access to a side of washing machine 14*b* opposite the side enclosed by service chase 32. A door in an opening between laundering area 26 and service chase 36 allows access to service chase 36 from laundering area 26.

In order to prevent particulates in soiled textiles in laundering area 26 from entering laundering area 28 (e.g., through washing machine 14*a*), a positive air pressure differential is maintained between the laundering area 28 and laundering area 26. Similarly, in order to prevent particulates in soiled textiles in laundering area 26 from entering laundering area 30 (e.g., through washing machine 14*b*), a positive air pressure differential is also maintained between the laundering area 30 and laundering area 26.

Further, in order to prevent particulates and other contaminants within service chases 32, 34, or 36 from entering laundering areas 28 or 30, a positive air pressure differential is maintained between laundering area 28 and adjacent service chases 32 and 34. Similarly, a positive air pressure differential is maintained between laundering area 30 and adjacent service chases 32 and 36. Thus when the door between laundering area 28 and service chase 32 is opened, air flows from laundering area 28 into service chase 32. Similarly, when the door between laundering area 26 and service chase 34 is opened, air flows from laundering area 26 into service chase 34. Further, when the door between laundering area 26 and service chase 36 is opened, air flows from laundering area 26 into service chase 36.

Textile laundering system 10 also includes a measurement system 38 for measuring the number and sizes of particulates present within textiles laundered using textile laundering system 10. As will be described in detail below, a portion of the textiles laundered using textile laundering system 10 may be subjected to a particulate measurement procedure after the textiles have been dried within dryers 16 for a predetermined length of time. The particulate measurement procedure includes measuring the number and sizes of particulates present within laundered textiles.

Figure 2:
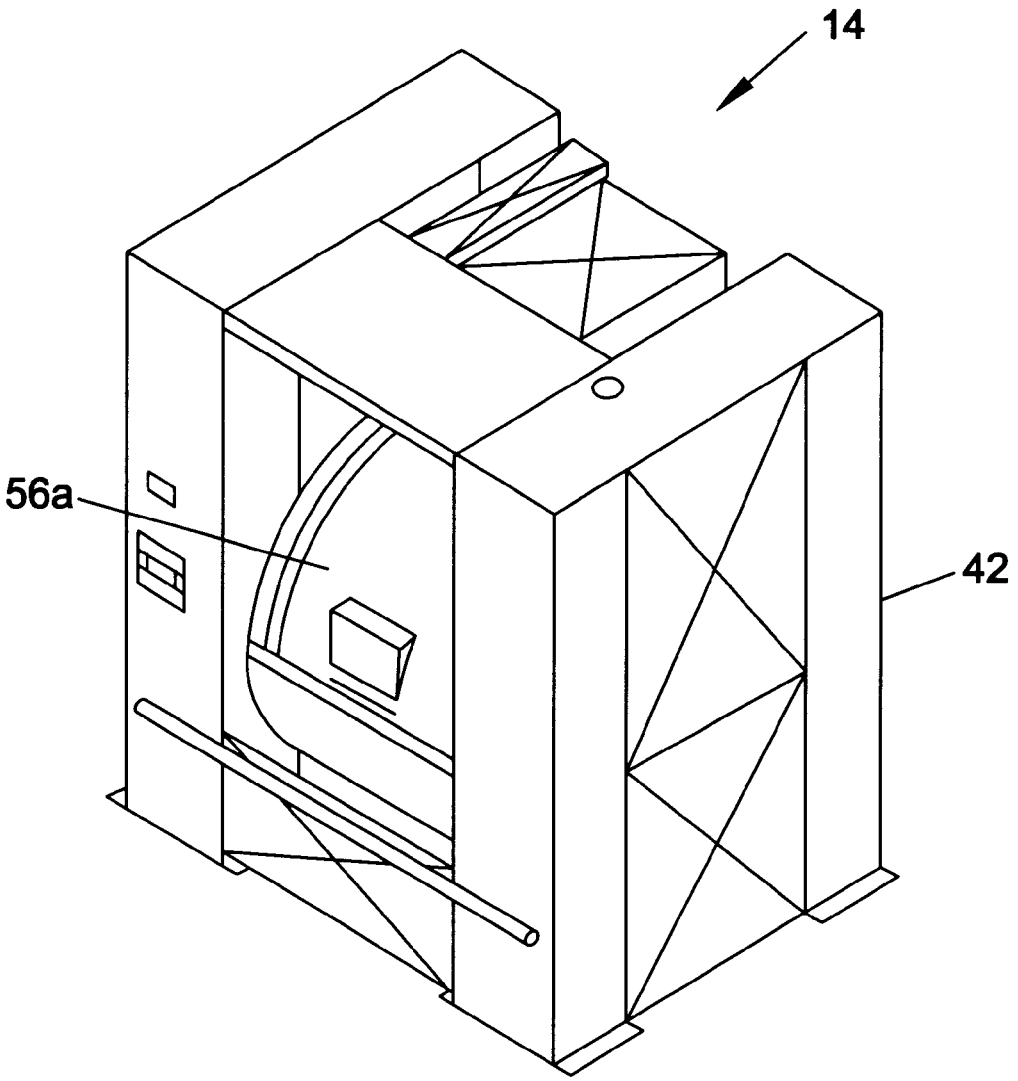
FIG. 2 is an isometric view of one embodiment of the washing machines of FIG. 1.
Figure 3:
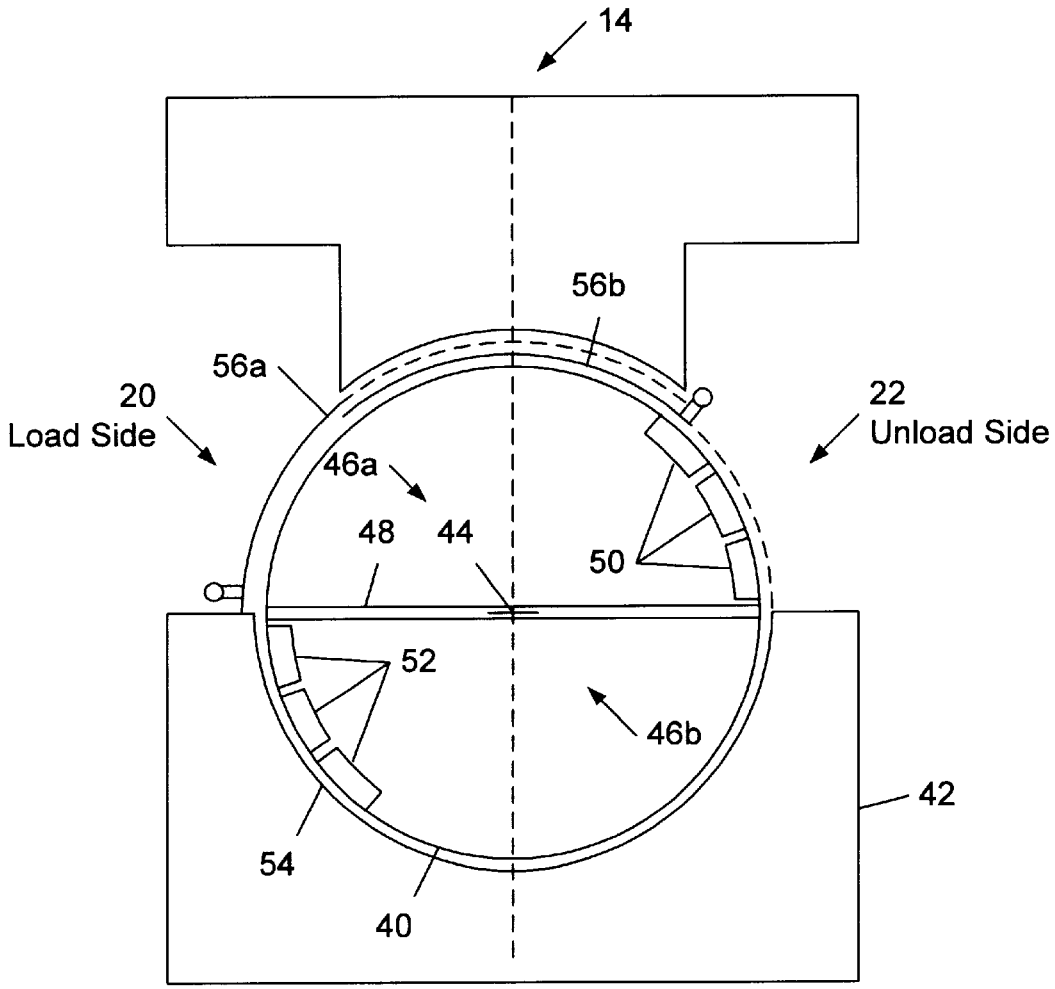
FIG. 3 is a cross-sectional view of the washing machine of FIG. 2.

FIG. 2 is an isometric view of one embodiment of washing machine 14, wherein washing machine 14 is a washer/extractor appliance including a cylindrical drum which rotates about a horizontal axis during use. FIG. 3 is a cross-sectional view of washing machine 14 of FIG. 2. Washing machine 14 includes a cylindrical drum 40 mounted within a housing 42. During a typical use, soiled textiles (e.g., garments) are placed within drum 40, drum 40 is filled to a certain level with water, a laundering agent (e.g., detergent) may be added to the water in drum 40, and drum 40 is rotated about a horizontal axis 44 in order to flush foreign substances from the garments.

Drum 40 is essentially a hollow cylinder with circular plates covering both open ends of the hollow cylinder. In the embodiment of FIG. 3, drum 40 is divided into two compartments or "pockets" 46*a* and 46*b* of substantially equal volume by a planar partition 48. Partition 48 is perpendicular to and extends between both circular plates of drum 40. Three access doors 50 in the curved outer surface of drum 40 allow access to pocket 46*a*. Similarly, three access doors 52 in the curved outer surface of drum 40 allow access to pocket 46*b*. During use, pockets 46*a* and 46*b* are preferably loaded with substantially equal weights of garments to minimize reciprocal motion imparted upon housing 42 by drum 40 due to rotating eccentric masses of wet garments.

As described above, washing machine 14 has a load side 20 and an unload side 22. Soiled garments are loaded into drum 40 from load side 20, and laundered garments are removed from drum 40 from unload side 22. Washing machine 14 also includes an outer shell 54 surrounding drum 40 having two arcuate shell doors 56*a* and 56*b*. Shell door 56*a* is located on load side 20 of washing machine 14, and is shown in a closed position. When drum 40 is suitably rotated and shell door 56*a* is in an open position, shell door 56*a* allows access to access doors 50 and 52 for loading soiled garments into respective pockets 46*a* and 46*b*. Shell door 56*b* is located on unload side 22 of washing machine 14, and is shown in an open position. As shown, shell door 56*b* allows access to access doors 50 for removing laundered garments from pocket 46*a*. When drum 40 is suitably rotated, open shell door 56*b* allows access to access doors 52 for removing laundered garments from pocket 46*b*.

A suitable washing machine is the Washex Model 46/39 washer/extractor (Washex Machinery Company, Wichita Falls, Tex.) which includes two pockets as described above. Table 1 below is a listing of a laundering program provided, as herein specified, to a controller of the Washex Model 46/39 in order to launder approximately 140 pounds of textiles (e.g., about 70 pounds of clean room garments in each pocket). The laundering program of Table 1 was developed empirically over a substantial period of time and represents a preferred laundering program.

TABLE 1

Laundering Program Listing.

| Step | Action |
|---|---|
| 1 | Fill 15 inches 120° F. 130° F. |
| 2 | Wait to Satisfy |
| 3 | Soap #1 7 sec |
| 4 | Wait to Satisfy |
| 5 | Run 15:00 min. |
| 6 | Drain 1 = 30 sec |
| 7 | Fill 16 inches 110° F. 120° F. |
| 8 | Wait to Satisfy |
| 9 | Run 8:00 min. |
| 10 | Drain 1 = 30 sec |
| 11 | Fill Cold 16 inches |
| 12 | Wait to Satisfy |
| 13 | Run 8:00 min. |
| 14 | Drain 1 = 30 sec |
| 15 | Fill Cold 16 inches |
| 16 | Wait to Satisfy |
| 17 | Run 8:00 min. |
| 18 | Drain 1 = 30 sec |
| 19 | Fill Cold 16 inches |
| 20 | Wait to Satisfy |
| 21 | Run 8:00 min. |
| 22 | Extract Low |
| 23 | Drain 1 = 5 min. |
| 24 | Extract High |
| 25 | Drain 1 = 3:30 min. |
| 26 | Signal |
| | End of Formula |

The program of Table 1 constitutes a method for laundering textiles (e.g., clean room garments), and includes a wash procedure followed by 4 serial rinse operations and 2 sequential spin (i.e., extraction) operations. Steps 1–6 make up the wash procedure. Prior to step 1, the textiles are placed within the drum of the washing machine. In step 1, the drum is filled to a predetermined level (15 inches) with water having a temperature within a predetermined range (between 120° F. and 130° F.). The water is "ultrapure" water substantially free of ions, minerals, and organic material. During step 3, a laundering agent (e.g., detergent) is added to the water. The laundering agent may be automatically dispensed into the washing machine, and a time period of seven seconds may be allowed to complete the automatic dispensing. During step 5, relative motion is induced between the textiles and the water for a predetermined period of time (15 minutes). When the Washex Model 46/39 washer/extractor "runs", the drum rotates in one direction about the horizontal axis for 16 seconds, stops for 4 seconds, then rotates about the horizontal axis in the opposite direction for 16 seconds. In step 6, the washing machine drain is opened for 30 seconds, allowing the water to drain from the drum.

Ultrapure water is used exclusively during the laundering process. In making the ultrapure water, drinking water from the city utility may be first passed through a particulate filter which removes relatively large dissolved particulates (e.g., sand, dirt, rust, and other sediment), then through an activated charcoal filter which removes organic substances and chlorine. The water under treatment may then be passed through a reverse osmosis unit which further removes dissolved particulates such as organic solids, and minerals such as calcium and magnesium, which are typically in electrically charged (i.e., ionic) form. The resulting ultrapure water is thus substantially free of ions, minerals, and organic material.

The laundering agent added to the water in the drum in step 3 may be, for example, a detergent. A suitable liquid laundry detergent is a product called "UltraClean L" made by Diversey Lever, Inc. (Plymouth, Mich.) and distributed by AmeriClean Systems, Inc. (Southfield, Mich.). As particles of detergent trapped within the fibers of the textiles may abrade the fibers and may be emitted by the textiles during use, a minimum amount of laundering agent is added to the water in the drum in step 3. For example, for a 140 pound load of textiles (70 pounds in each pocket), only about 2 ounces of UltraClean L may be added to the water in the drum in step 3.

Steps 7–10 make up the first rinse operation. In step 7, the drum is filled to a predetermined level (16 inches) with ultrapure water having a temperature within a predetermined range (between 110° F. and 120° F.). In step 9, relative motion is induced between the textiles and the water for a predetermined period of time (8 minutes) as the washer runs. In step 10, the washing machine drain is opened for 30 seconds, allowing the water to drain from the drum.

Steps 11–14, 15–18, and 19–21 make up the second, third, and fourth rinse operations, respectively. In steps 11, 15, and 19, the drum is filled to a predetermined level (16 inches) with ultrapure water from a cold water supply line and having a temperature between about 55° F. and approximately 80° F. In steps 13, 17, and 21, relative motion is induced between the textiles and the water for a predetermined period of time (8 minutes) as the washer runs. In steps 14 and 18, the washing machine drain is opened for 30 seconds, allowing the water to drain from the drum. The fourth rinse operation overlaps the first spin operation which immediately follows the fourth rinse operation.

Steps 22–23 make up the first spin operation. During steps 22–23, the drum is rotated about the horizontal axis at a relatively low rate of speed for a time period of 5 minutes such that water is substantially removed from the textiles by centrifugal force. The washing machine drain is opened during the spin operation.

Steps 24–25 make up the second spin operation. During steps 24–25, the drum is rotated about the horizontal axis at a relatively high rate of speed for a time period of 3.5 minutes such that water is substantially removed from the textiles by centrifugal force. During steps 24–25, the textiles in the drum may be subjected to a centrifugal force having a magnitude equal to about 222 times the force of gravity. The washing machine drain is opened during the spin operation. Step 26 activates an audible signal which informs an operator that the laundering process is complete.

Following the wash procedure and rinse and spin operations, the textiles may be subjected to a drying operation. During the drying operation, the textiles may be removed from washing machine 14 and placed in corresponding dryers 16. As described above, washing machine 14 has two pockets. The contents of each pocket may be placed in a separate dryer 16. Dryers 16 may be operated to remove residual water from the textiles. Dryers 16 may have cylindrical drums which rotate about an axis passing through the drum during use, and may have access doors for loading textiles (e.g., clean room garments) into the drum and for removing textiles from the drum.

Figure 4:
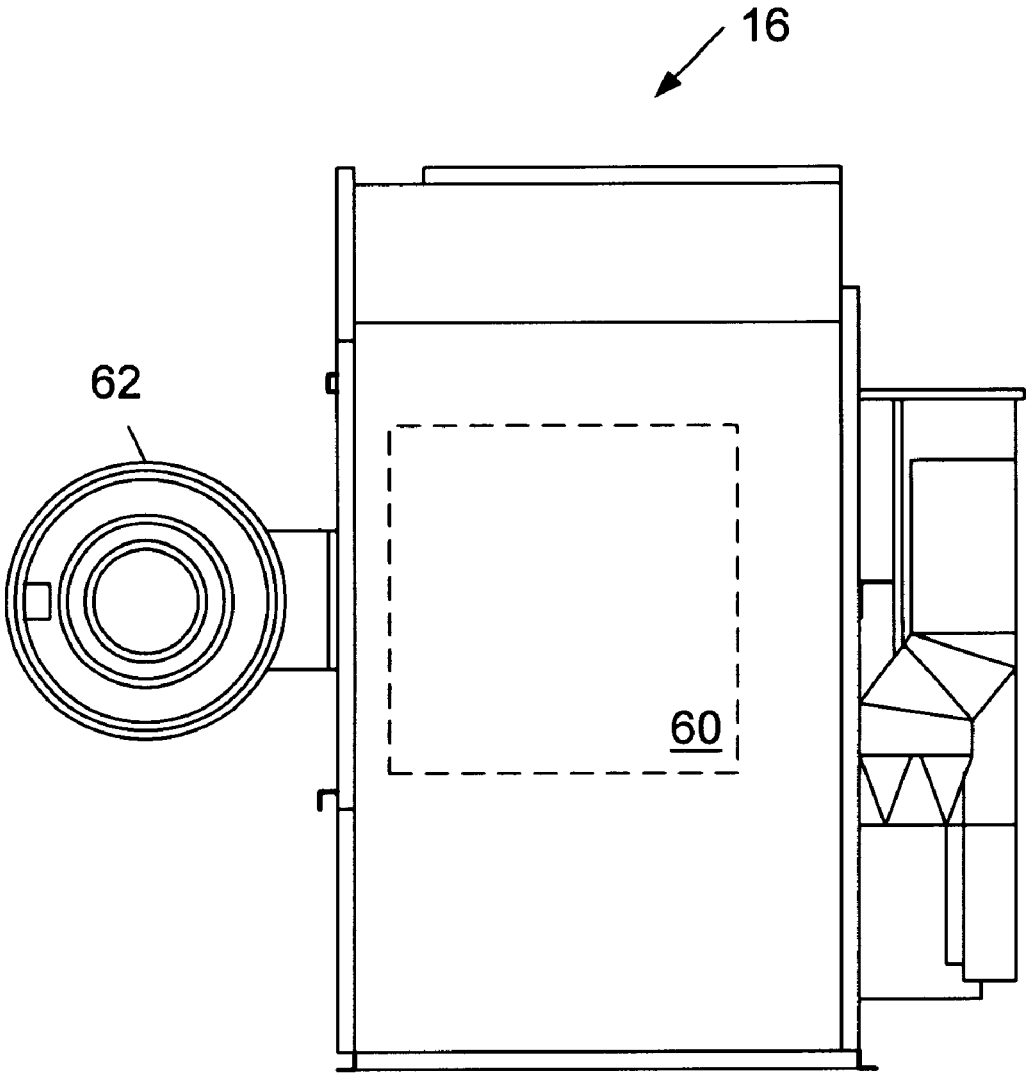
FIG. 4 is a side elevation view of one embodiment of the dryers of FIG. 1.

A suitable dryer is the model Huebsch 150 manufactured by Alliance Laundry Systems (Ripon, Wis.). FIG. 4 is a side elevation view of the model Huebsch 150 dryer, including a cylindrical drum 60 and an access door 62. The dryers may be modified to include an air input port as well as an air output port, and the internal fan and heat source normally included with the dryers may be excluded. The dryers may receive air from an external air handling unit. During use, each dryer may input a quantity of air through the air input port and exhaust a substantially equal quantity of air through the air output port.

Figures 5A, 5B:
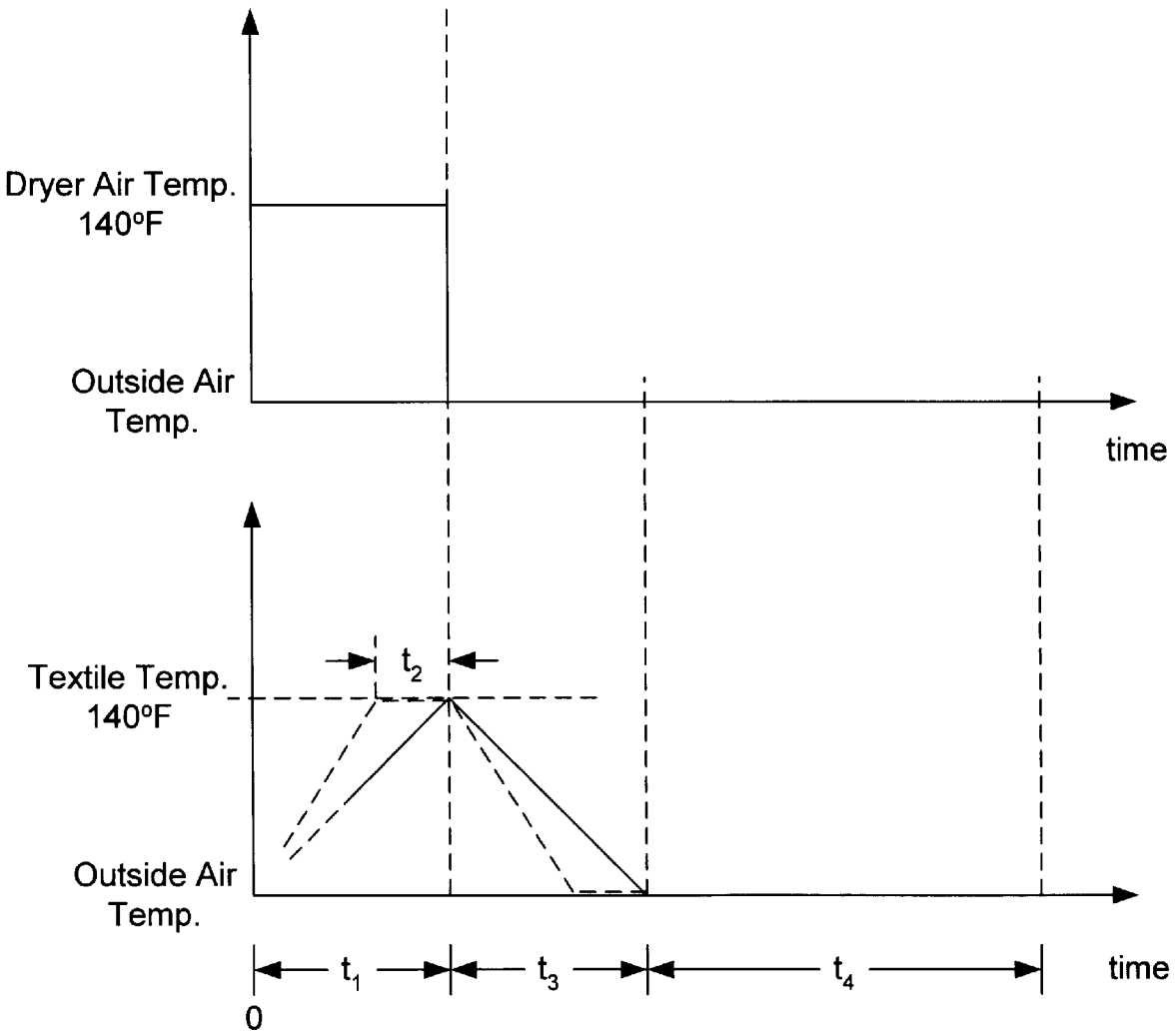
FIG. 5*a* is a graph of the temperature of air supplied to one or more of the dryers of FIG. 1 during a drying operation.
FIG. 5*b* is a graph of the temperature of the textiles within the one or more dryers of FIG. 1 during the drying operation.

FIGS. 4, 5*a*, and 5*b* will now be used to describe the drying operation. The textiles are first placed in drum 60 of dryer 16, and access door 62 is closed. Drum 60 is rotated about its horizontal axis during the drying operation, and air is circulated through drum 60 such that moisture-laden air is removed from drum 60 and relatively dry air is added to drum 60. FIG. 5*a* is a graph of the temperature of the air supplied to dryer 16 during the drying operation. The drying operation begins at time 0. For a time period "$t_1$" at the beginning of the drying operation, heated air is supplied to drum 60. The heated air is able to hold more moisture and also heats the textiles within drum 60, increasing the evaporation rate of water retained within the textile fibers.

During time period $t_1$ the temperature of the air supplied to drum 60 is preferably a maximum and substantially constant as shown in FIG. 5*a*. When the textiles are polyester, the temperature of the air supplied to drum 60 is preferably about 140° F. as shown in FIG. 5*a*. Time period $t_1$ is preferably long enough for the textiles to substantially reach the temperature of the heated air supplied to drum 60. The temperature of the textiles within drum 60 may be measured by, for example, opening access door 62 and using a laser temperature probe to measure the temperature of the textiles. A time period $t_1$ of about 15 minutes has proven sufficient for a 70 pound load of polyester garments. After time period $t_1$ and for the remainder of the drying operation, filtered outside air is supplied to drum 60. Thus the temperature of the air supplied to drum 60 following time period $t_1$ is substantially equal to the outside air temperature (between about 40° F. and approximately 95° F.).

FIG. 5*b* is a graph of the temperature of the textiles within dryer 16 during the drying operation. At time 0, the temperature of the textiles may be substantially the temperature of the water used in the final rinse operation. During time period "$t_1$" at the beginning of the drying operation, the temperature of the textiles rises to the temperature of the heated air supplied to drum 60 (about 140° F.). The time required to raise the temperature of the textiles to the temperature of the air supplied to drum 60 is dependent upon the amount of textiles placed in drum 60 (i.e., the volume and/or weight of the load). Smaller loads may heat up quickly, remaining at the temperature of the heated air supplied to drum 60 for a time period "$t_2$". When the textiles are polyester, it is desirable that time period $t_2$ not exceed about 5 minutes as heat degrades the fabric and shortens the useful life of the textiles. After time period $t_1$ and for the remainder of the drying operation, filtered outside air is supplied to drum 60 as described above. During a time period "$t_3$" following time period $t_1$ the temperature of the textiles in drum 60 decreases to substantially the temperature of the outside air (between about 40° F. and approximately 95° F.). Time period $t_3$ may be, for example, 15 minutes. During a time period "$t_4$" following time period $t_3$, the temperature of the textiles in drum 60 remains substantially the temperature of the outside air. The length of time period $t_4$ is dependent upon the temperature and humidity of the outside air supplied to drum 60. Time period $t_4$ may be, for example, 45 minutes. At the end of time period $t_4$ the textiles within drum 60 are preferably substantially dry.

Figure 6:
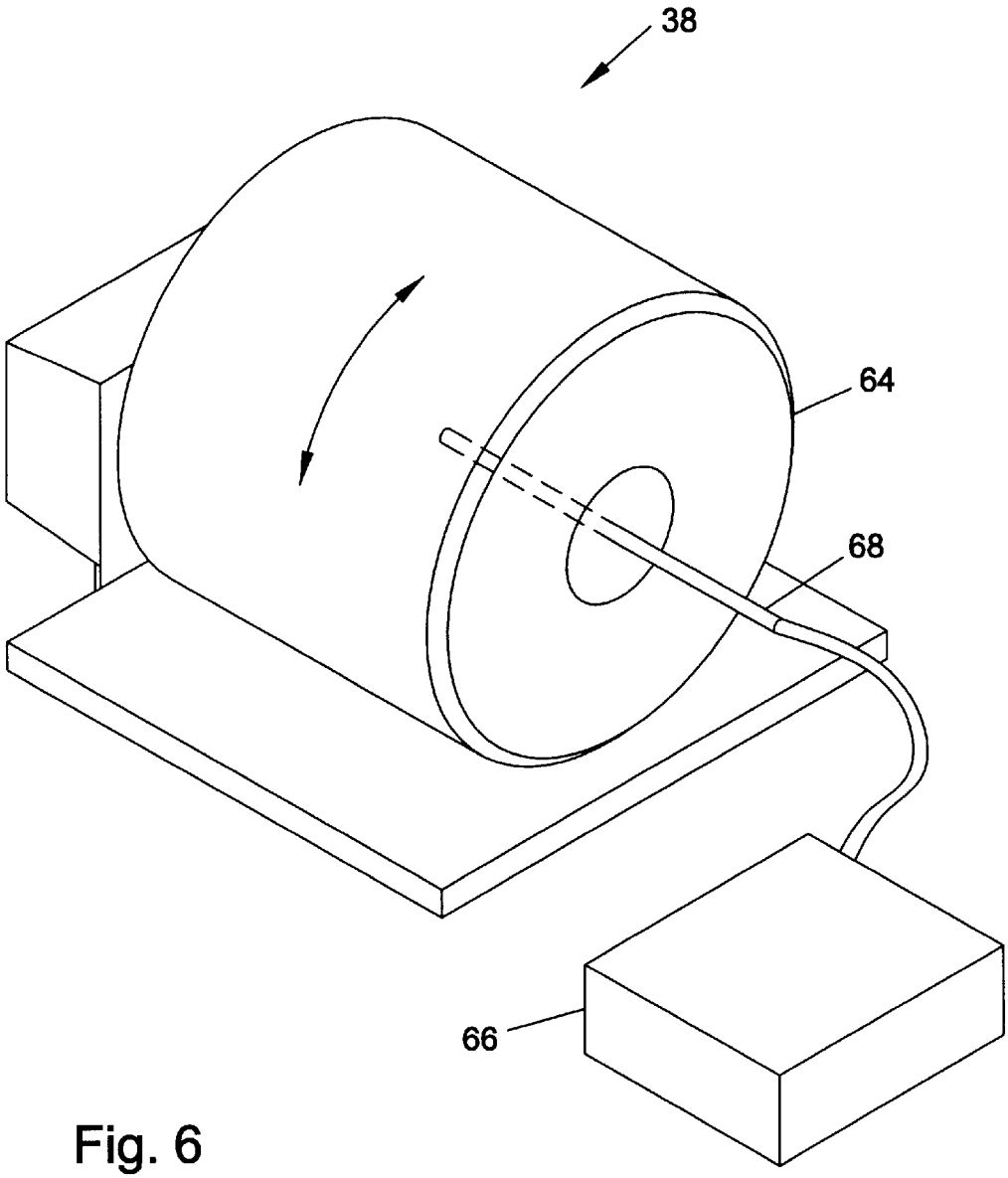
FIG. 6 is an isometric view of one embodiment of the measurement system of FIG. 1.

Following the drying operation, a portion of the textiles may be subjected to a particulate measurement procedure. FIG. 6 is an isometric view of one embodiment of measurement system 38 for measuring the number and sizes of particulates present within textiles laundered using textile laundering system 10. Measurement system 38 includes a Helmke drum 64 and an aerosol particle counter 66. During a preliminary step in the particulate measuring procedure, Helmke drum 64 may be set into rotational motion about its horizontal axis and a probe 68 of particle counter 66 may be inserted into an opening in Helmke drum 64 as shown in FIG. 6. The air within Helmke drum 64 may be sampled using particle counter 66 in order to obtain background particle counts. During such air sampling, air is drawn through an opening in an end of probe 68 and into particle counter 66 at a rate of, for example, 1 cubic foot per minute (1 CFM). Background particle counts may be obtained by sampling the air within Helmke drum 64 for, for example, 1 minute periods. The background particle counts may be recorded for future reference.

During the particulate measuring procedure, a portion of the textiles in drum 60 of dryer 16 are placed within Helmke drum 64. For example, one hood and one gown from a 70 pound load of clean room garments may be removed from drum 60 and placed within Helmke drum 64. Helmke drum 64 may then be set into rotational motion about its horizontal axis, and probe 68 of particle counter 66 may be inserted into the opening in Helmke drum 64 as shown in FIG. 6. The number and sizes of particulates present within the textiles laundered using textile laundering system 10 may be determined by, for example, taking 6 consecutive 1-minute air samplings, recording the results, then averaging the results. The resulting average values of particulate numbers and/or sizes may be compared to predetermined maximum allowable values. If the resulting average values of particulate numbers and/or sizes are less than the predetermined maximum allowable values, the textiles (e.g. clean room garments) will emit acceptable levels of particulates during use and may be used within the clean room.

The above system and method for laundering clean room garments has resulted in a marked increase in the useful lives of clean room garments. For example, the useful lives of smocks and gowns have been increased from an expected value of about 80 laundering cycles to approximately 400 laundering cycles. The increased longevity is attributed chiefly to the reduced amount of detergent added during the wash operation and the reduced amount of time the clean room garments are exposed to temperatures above about 100° F. Such increased longevity saves money and reduces the amount of time required to maintain an adequate clean room garment inventory.

It will be appreciated by those skilled in the art having the benefit of this disclosure that this invention is believed to be a system and method for laundering clean room garments within a clean room facility. It is intended that the following claims be interpreted to embrace all such modifications and changes and, accordingly, the specification and drawings are to be regarded in an illustrative rather than a restrictive sense.

What is claimed is:

1. A textile laundering system, comprising:

a washing machine having two opposed sides and at least one equipment access portion, wherein one side is a loading side for loading textiles into the washing machine and the other side is an unloading side for unloading textiles from the washing machine, and wherein the washing machine is positioned within a sealed opening in a vertical partition separating a first laundering area from a second laundering area such that the loading side is located within the first laundering area and the unloading side is located within the second laundering area;

a dryer having at least one equipment access portion;

means for measuring the number and sizes of particulates present within laundered textiles; and wherein the equipment access portions of the washer and dryer are enclosed within at least one service chase area separate from the first and second laundering areas.

2. The textile laundering system as recited in claim 1, wherein a positive air pressure differential is maintained between the second and first laundering areas.

3. The textile laundering system as recited in claim 1, wherein a positive air pressure differential is maintained between the first laundering area and the at least one service chase.

4. The textile laundering system as recited in claim 1, wherein the at least one service chase has an access door positioned in an opening between the at least one service chase and the first laundering area, and wherein a positive pressure differential is maintained between the first laundering area and the at least one service chase such that when the access door is opened, air flows from the first laundering area and into the at least one service chase.

5. The textile laundering system as recited in claim 1, wherein the at least one service chase has an access door positioned in an opening between the at least one service chase and the second laundering area, and wherein a positive pressure differential is maintained between the second laundering area and the at least one service chase such that when the access door is opened, air flows from the second laundering area and into the at least one service chase.

6. The textile laundering system as recited in claim 1, wherein the textile laundering system is located within a clean room, and wherein the textile laundering system is used to launder clean room garments.

7. The textile laundering system as recited in claim 1, wherein the washing machine uses water to launder the textiles, and wherein the water is substantially free of ions, minerals, and organic material.

8. The textile laundering system as recited in claim 1, wherein the means for measuring the number and sizes of particulates present within laundered textiles comprises a Helmke drum and an aerosol particle counter.

* * * * *